US006287127B1

(12) United States Patent
Hibino et al.

(10) Patent No.: US 6,287,127 B1
(45) Date of Patent: Sep. 11, 2001

(54) ELECTRICAL SOCKET APPARATUS

(75) Inventors: Yasushi Hibino, Shizuoka; Hideyuki Takahashi, Gotenba; Toyokazu Ezura, Kawasaki; Kiyokazu Ikeya, Shizuoka; Yasuhiro Ochiai, Tokyo, all of (JP)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/694,636

(22) Filed: Oct. 23, 2000

(30) Foreign Application Priority Data

Nov. 30, 1999 (JP) ..... 11-341360

(51) Int. Cl.[7] ..... H01R 12/00
(52) U.S. Cl. ..... 439/70; 439/71; 439/331
(58) Field of Search ..... 439/70, 71, 342, 439/266

(56) References Cited

U.S. PATENT DOCUMENTS 4,468,072 * 8/1984 Sadigh-Behzadi ..... 439/74
5,147,213 * 9/1992 Funk et al. ..... 439/266
5,807,127 * 9/1998 Ohshima ..... 439/266
6,027,355 2/2000 Ikeya ..... 439/268
6,050,836 * 4/2000 Tohyama ..... 439/266
6,126,467 * 10/2000 Phashi ..... 439/268

* cited by examiner

*Primary Examiner*—Tulsidas Patel
(74) *Attorney, Agent, or Firm*—Russell E. Baumann; Frederick J. Telecky, Jr.

(57) ABSTRACT

A socket (1) includes a body (1*a*) and a cover (3). Body (1*a*) has a base (2) having a horizontally movable slide (4) thereon on which a BGA package can be mounted and a plurality of contact members (6) arranged on base (2) corresponding to a pattern of solder balls of the BGA package. Each of contact members (6) has a pair of spring arms (6*a*, 6*b*) which can be opened and closed in response to movement of slide (4). In one embodiment, a cover (3) is vertically movable relative to body (1*a*). The cover (3) has motion transfer portions (31) having a wedge shape which are engageable with tapered force receiving portions (43) of slide(4). As cover (3) is pushed down, engagement surfaces (31) of motion transfer portions (30) engage force receiving surfaces (43) of slide (4) and slide (4) moves so that arms (6*a*, 6*b*) of contact members (6) are opened. In another embodiment, the motion transfer parts (31) are provided on a head (11) which has an air suction holder for a BGA package.

14 Claims, 5 Drawing Sheets

ELECTRICAL SOCKET APPARATUS

FIELD OF THE INVENTION

This invention relates to an electrical socket for removably loading an electric part such as an IC (integrated circuit) having electrical terminals on its lower surface and electrically connecting each terminal to external equipment and more particularly to such a socket especially adapted for use with semiconductor packages of the BGA (Ball Grid Array) type.

BACKGROUND OF THE INVENTION

Ordinarily, plastic encapsulated IC packages are subjected to electric property tests and a reliability test called a burn-in test prior to shipment in order to distinguish between good and defective products. In an electrical property test, input and output characteristics of the IC chip, pulse properties, noise leeway, and the like, are tested. Those IC packages that pass the electric property test are then subjected to a burn-in test in which they are arranged in an oven and caused to function for a certain period of time at a selected high temperature, for example, 125° C., and under a source voltage which is approximately 20 per cent higher than the rated value. IC packages that fail the burn-in test are discarded as defective products and only those IC packages that continue functioning properly are shipped out as good products.

BGA packages having spherical solder balls arranged on the lower side of the packages in a selected matrix or zigzag fashion are in wide use. This type of package is capable of having an increased terminal pitch with a small outer dimension and is more resistant to damage caused by contact with other parts. FIGS. 6*a* and 6*b* show a typical prior art socket used for burn-in tests of IC's such as BGA packages. Socket 101 comprises a plastic (in plan view) rectangular base 102 on which is mounted a horizontally movable slider 103 which receives thereon a BGA package. A frame shaped cover defining an opening 104*a*, also made of plastic, is received on top of base 102 and is vertically movable relative to the base. The cover is biased in a direction away from the base by means of compression coil springs 105. A through hole corresponding to each solder ball 100*a* of the BGA package is formed in slider 103 and base 102. A contact member 106 for electrical connection with a respective solder ball 100*a* of the BGA package is arranged to run through each of the through holes of slider 103 and base 102. Each contact member 106 comprises an elongated metallic member having a pair of arms 106*a* and 106*b* provided at one end thereof. Each contact member 106 is fixed in a vertical attitude on base 102, with arms 106*a* and 106*b* facing upwardly. Each contact member has a protruding part such as a tab (not shown in the drawing), on one of side by side arms 106*a*, 106*b*. Arms 106*a*, 106*b* open relative to one another as the tab engages with a partition wall (not shown in the drawing) of slider 103. A sliding mechanism for moving slider 103 in parallel with the bottom of base 102 comprises a pair of generally L-shaped lever member 108 rotatably connected at opposite ends of a shaft 107. Shaft 107 is received in a slot formed at the right side of slider 103 as seen in the drawings. A short arm 108*a* of each lever member 108 is rotatably connected to a shaft 109 mounted in base 102 thereof at one side (the right-hand side shown in the drawing), installed so that it extends in parallel with shaft 107. A respective lever member 111 is rotatably connected at both ends of a shaft 110 mounted on the opposite side of base 102 and extending in parallel with shafts 107, 109 and the end portion of each lever member 108 is slidably connected in a longitudinally extending slot formed in the middle part of lever members 111 by means of pins 112. The distal tip 11*la* of lever member 111 engages a protruding part 104*b* of the top wall of cover 104. Horizontally disposed compression coil springs 113 are placed between base 102 and slider 103 in the vicinity of shaft 110 for biasing the slider in the direction shown by the head of arrow X in FIG. 6*b*.

In a socket 101 constructed as described above, if cover 104 is pressed down from the position shown in FIG. 6*a* to the position shown in FIG. 6*b*, lever members 108 and 111 rotate toward base 102 and shaft 107 moves slider 103 in conformity with the movement of lever member 108, thereby shifting it in the opposite direction from the one indicated by arrow head X. As a result of this, one of the arms, for example, arm 106*a* of each contact member 106, engages the partition wall of slider 103 and is thereby opened. If, in this state, BGA package 100 is inserted into adaptor 103*c* of slider 103, each solder ball 100*a* of BGA package 100 enters the gap between the open arms 106*a* and 106*b* of a respective contact member 106. When the downward force on cover 104 is removed, lever members 108 and 111 rise and slider 103 moves in the direction of the head of arrow X by means of the force exerted by compression coil springs 113, closing arms 106*a* and 106*b* of each contact member 106 with each solder ball 100*a* of BGA package 100 held by arms 106*a* and 106*b* of a respective contact member 106. As a result of this, each solder ball 100*a* of BGA package 100 can be electrically connected to a respective contact member 106.

In the case of a prior art socket as described above, however, the linkage mechanism made by lever members 108, 111 and associated shafts used for moving slider 103 requires an increased number and complexity of parts along with an increase in the number of steps and time for assembling the product.

Further, such linkage mechanisms increase the size and weight of the socket itself.

SUMMARY OF THE INVENTION

An object of the present invention is the provision of an electrical socket of light weight and small size in which the number of parts involved is small and the construction is simple. Another object of the invention is the provision of a socket which overcomes the limitations of the prior art noted above and having fewer parts, of a simple structure, light weight and small size.

An electrical socket made in accordance with the invention comprises a base for removably loading an electric part such as a plastic encapsulated IC package in which the conductive terminals of the electric part are arranged according to a selected pattern, a plurality of contact members arranged in the base in accordance with the arrangement pattern of the conductive terminals of the electric part with each contact member having a pair of contact arms capable of elastically opening and closing to sandwich a respective conductive terminal of the electric part. A contact actuating member is provided having engagement parts for engaging with at least one arm of each pair of contact arms of each contact member to open or close the contact arms. The contact actuating member moves in the opening and closing direction of the contact arms by receiving an external force on a force receiving surface in a direction which crosses, approximately at a right angle, the opening and closing direction of the contact arms. The force receiving surface includes a portion inclined by a selected angle relative to the direction of the external force. According to a feature of the invention, a motion transfer portion engages the force receiving surface of the contact actuating member. The movement of the motion transfer portion is in a direction which crosses, approximately at a right angle, the opening and closing direction of the contact arms. According to the first preferred embodiment, the motion transfer portion extends downwardly from a cover positioned over the socket body. According to a feature of an alternate embodiment, the motion transfer portion extends downwardly from a head movable toward and away from the socket base, the head provided with a holding part which is capable of removably holding the electric part. According to another feature of the alternate embodiment, the head holds the electric part by air suction.

According to the invention, the motion transfer portion directly engages force receiving surfaces of the contact actuating member for moving the contact actuating member in the opening and closing direction of the contact arms. Accordingly, prior art lever members and associated linkage mechanism are no longer necessary. As a result, the number of the parts is drastically reduced and, at the same time, the construction simplified. In addition, the assembling steps can also be simplified. According to the invention, moreover, the size of the socket itself can be reduced and, at the same time, its weight can be drastically reduced.

These and other objects and features of the invention will be apparent to the following description taken with reference tot the accompanying drawings.

BRIEF DESCRIPTION OF THE DRAWINGS

Preferred embodiments of a socket made according to the invention will be explained below in detail by referring to the attached drawings.

DETAILED DESCRIPTION OF THE PREFERRED EMBODIMENTS

Figure 1:
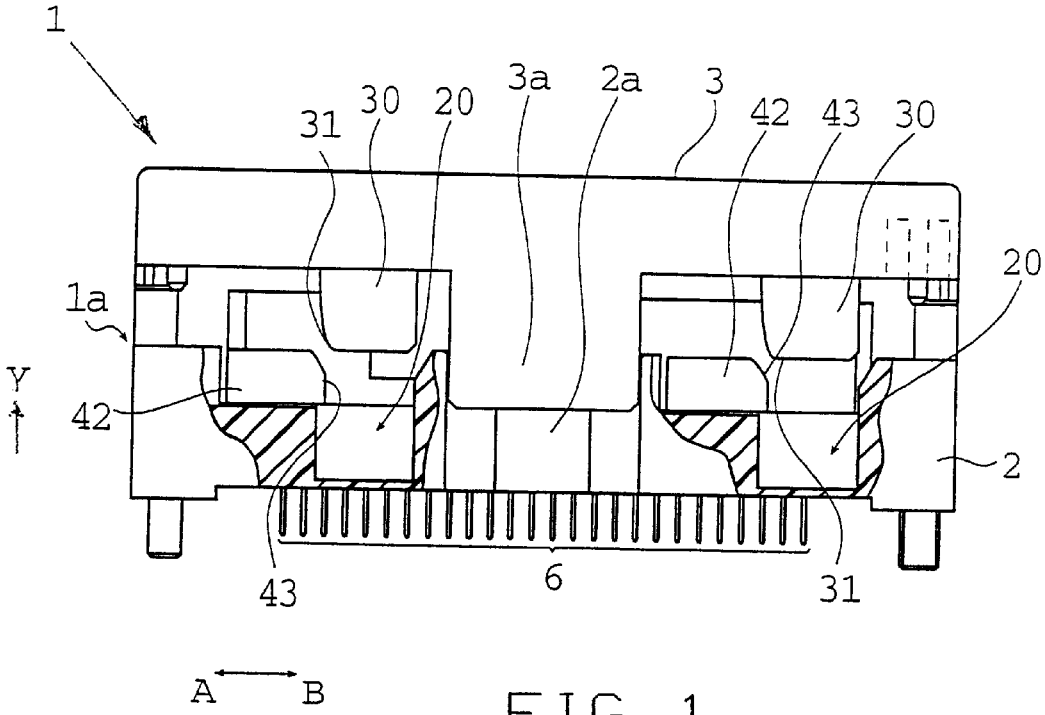
FIG. 1 is a front elevational view, partly in cross section, showing an electrical socket having a cover 3 in the raised position.
Figure 2:
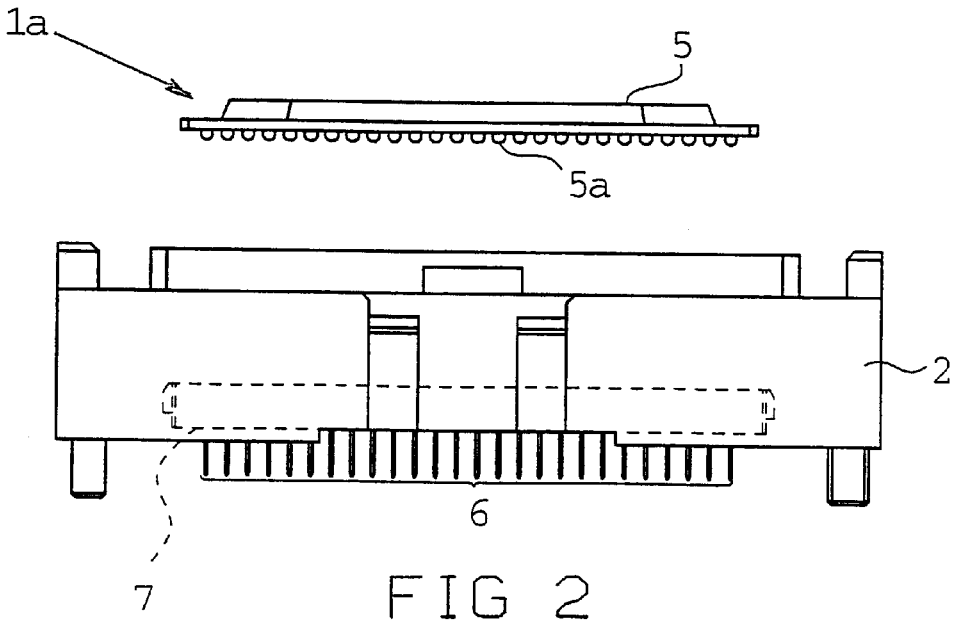
FIG. 2 is a front elevational view of the main body of the FIG. 1 socket and a BGA package receivable in the socket.

With reference to FIGS. 1–4, socket 1 comprises a main socket body l*a*having a base 2 and a slide member 4 which serves as; an actuation member disposed on the base. A cover 3 is received on base 2 for providing a contact actuation force. These components are composed of suitable moldable plastic such as polyetherimide, etc. Base 2 is formed in a suitable configuration, such as a rectangular shape, as seen in a top plan view, and has a contact member support portion 7, as shown in FIG. 2, formed at the center of the base for mounting a large number of contact members 6 for attachment to a circuit substrate, such as a printed circuit board (not shown in the drawing). Cover 3 is formed as a window frame in a shape and size complimentary to base 2, with an opening (not shown in the drawing) being formed for the insertion of a BGA package (electric part) at its center. A guide portion 3*a* extends downwardly from each side of cover 3 and is slidably received in a respective guide groove 2*a*provided on each side of base 2. Cover 3 moves toward and away from base 2 while maintaining a mutually parallel relationship therewith. Compression coil spring means (not shown) are provided between cover 3 and base 2 to bias cover 3 in a direction away from the base to normally cause their mutual separation.

Figure 3A:
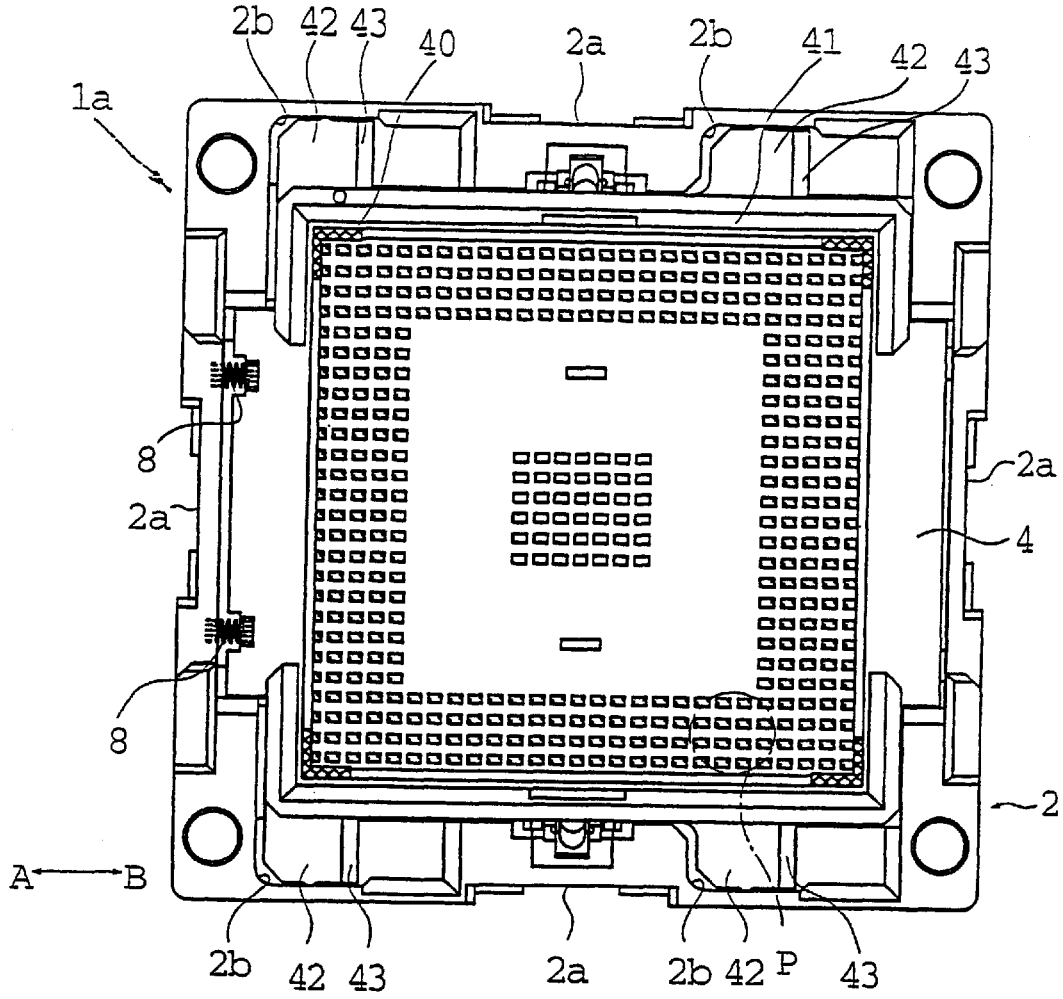
FIG. 3*a* is a top plan view showing the external appearance of the FIG. 2 main socket body.
Figure 3B:
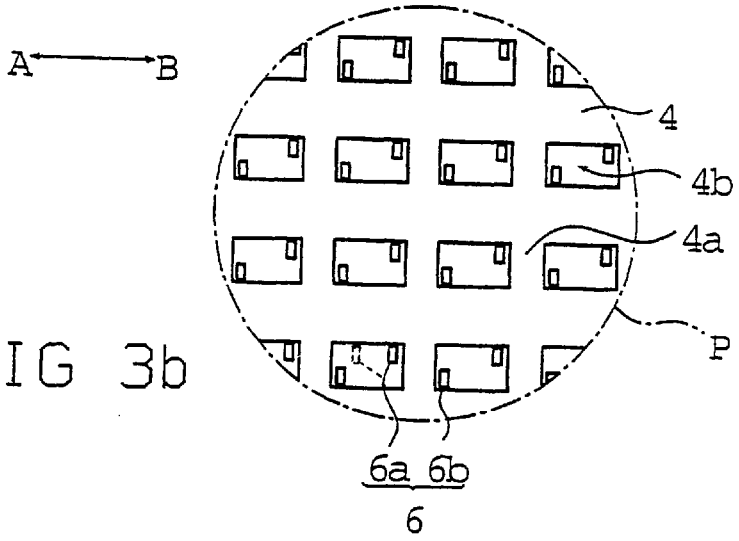
FIG. 3*b* is an enlarged portion of FIG. 3*a;*

As shown in FIG. 3*a*, seating parts 40 are provided on the upper surface of slide member 4 at each corner thereof for the placement of a BGA package 5. A positioning guide 41 is provided around seating parts 40 for guiding and positioning the BGA package at a preselected location. A lattice-shaped partition wall, also called engagement part 4*a*, is formed by a large number of through holes 4*b*. The partition wall is disposed inside the seating parts 40 on top of slider 4. The distal free end tips of a pair of arms 6*a* and 6*b* of each contact member 6 run through the holes and protrude above the top of slide member 4. Each contact member is arranged so that arms 6*a*, 6*b* are disposed on opposite sides of a partition wall 4*a* of slider member 4, as seen in FIG. 3*b*. That is, arms 6*a*, 6*b* of each contact 6, are positioned in different adjacent through holes 4*b* so that upon the movement of slide member 4 in the direction indicated by arrowhead A, arm 6*a* is moved to the dotted line position (open position) relative to arm 6*b* as shown in FIG. 3*b*. Slide member 4 is so constructed as to be able to move in the opening and closing directions of arms 6*a*, 6*b* of contact members 6 on base 2.

Figure 4:
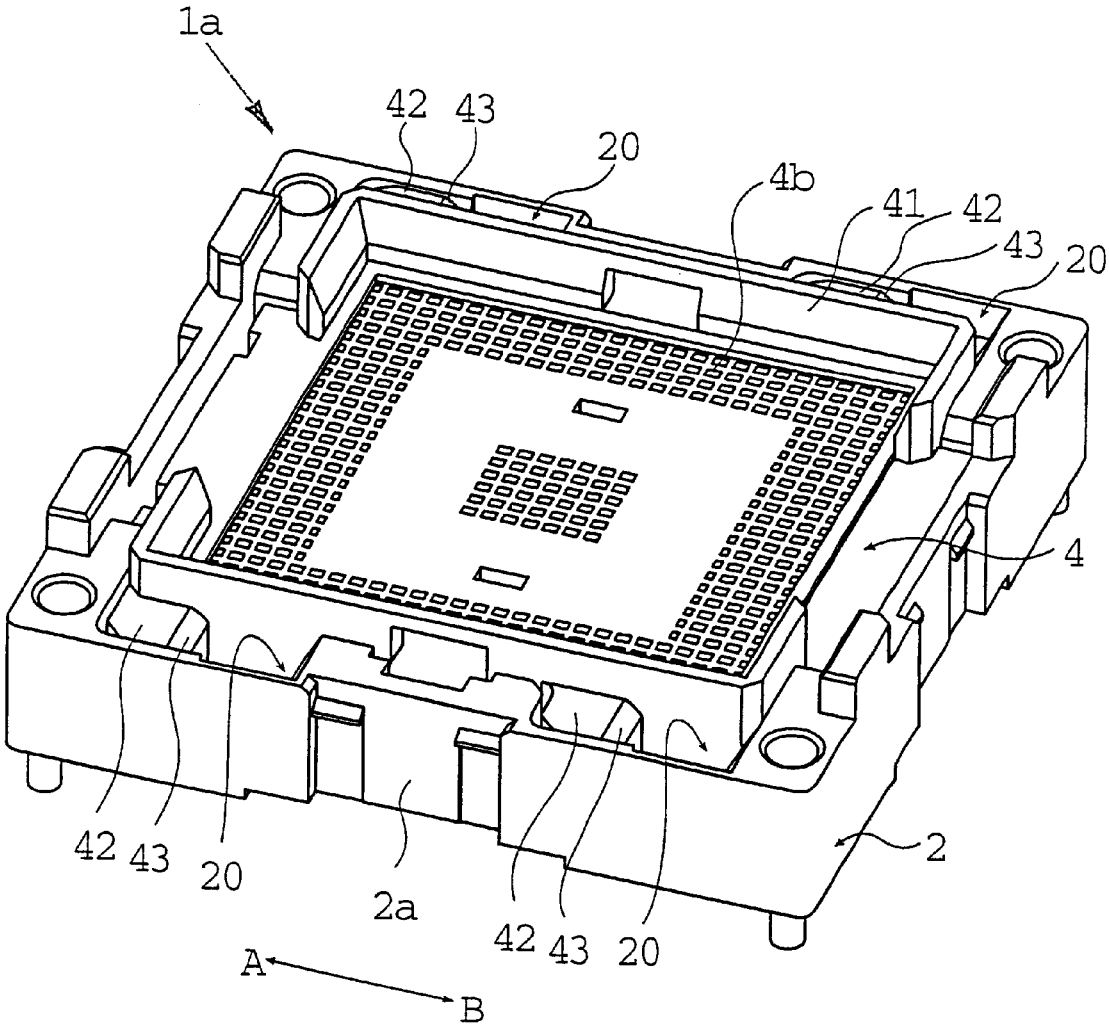
FIG. 4 is a perspective view showing the external appearance of the main socket body.

Positioning parts 42 are provided on two opposite sides of slide member 4, as shown in FIGS. 3*a* and 4. As these positioning parts 42 are guided by the inner surface 2*b* of base 2, slide member 4 is movable in the direction indicated by arrow head A or B which are the opening and closing directions of arms 6*a*, 6*b* of contact members 6. Slide member 4 is biased away from movable arms 6*a* by the spring force of compression coil springs 8 when no external force is applied to cover 3. A force receiving surface 43, shown in FIG. 1, is formed at the top of each positioning part 42 of slide member 4 for receiving an external force to open arms 6*a*, 6*b* of contact members 6. Force receiving surface 43 is disposed at a location on the side of positioning part 42 of slide member 4 indicated by arrow head B. Each force receiving surface 43 is tapered to lie in a generally flat plane, inclined by a selected angle, in the opening and closing directions of arms 6*a*, 6*b* of contact members 6. The angle of inclination of each force receiving surface 43 is not restricted as long as it is greater than zero and smaller than 90° relative to the opening and closing direction of arms 6*a*, 6*b* of contact members 6. Each force receiving surface 43 can also be formed as a curved surface, if desired. Motion transfer portions 30 are formed on cover 3, for providing an external force to each force receiving surface 43 of the slide member as the cover is depressed. Motion transfer portions 30 extend downwardly from cover 3 at an interval which is the same as the interval of the receiving surfaces 43 of slide member 4 at a position on cover 3 that corresponds to slide member 4. An engagement surface 31 is formed at a position on the side of each motion transfer portion 30 of cover 3 indicated by the side in which the arm 6*a* of the contact 6 is opened. According to the preferred embodiment, engagement surfaces 31 are preferably each formed having a wedge shape with a slight curve at the bottom thereof. As shown in FIG. 1, openings 20 are formed in base 2 having a depth and size to slidingly receive each respective motion transfer portion 30 at a position corresponding to each motion transfer portion of cover 3. Cover 3 is disposed at a location away from base 2 due to the force of compression coil springs in the absence of a downward force on the cover so that engagement surfaces 31 of motion transfer portions 30 of cover 3 and the receiving surfaces 43 of slide member 4 are out of engagement with each other.

When cover 3 is pressed down from the raised position, engagement surface 31 of each motion transfer portion 30 of cover 3 engages each respective force receiving surface 43 of slide member 4 and, as an external force, including the component in the direction indicated by the head of arrow A, works on each of these force receiving surfaces 43, slide member 4 moves in the direction which is indicated by arrow head A and partition wall 4*a* engages with arm 6*a* of each contact member 6, with a result that the arms 6*a*, 6*b* are opened relative to one another. When, in this state, a BGA package 5 is placed on seating parts 40 of slide member 4 and the downward force on cover 3 is removed, a reverse procedure occurs and arms 6*a*, 6*b* of each contact member 6 are closed and each solder ball of BGA package 5 is compressively engaged by a respective pair of arms 6*a*, 6*b*.

The removal of BGA package 5 is effected by pressing the cover 3 once again to open the arms of the contact members 6.

In the embodiment described above, engagement surfaces 31 of cover 3 are caused to directly engage the respective force receiving surfaces 43 of slide member 4, thereby causing slide member 4 to move in the opening and closing directions of arms 6*a*, 6*b*. Accordingly, the prior art lever members and linkage mechanism are no long necessary thereby reducing the number of parts used and, at the same time, simplifying the structure. Further, the assembling steps 5 are also simplified. According to the invention, moreover, the size and weight of the socket can be reduced.

Figure 5:
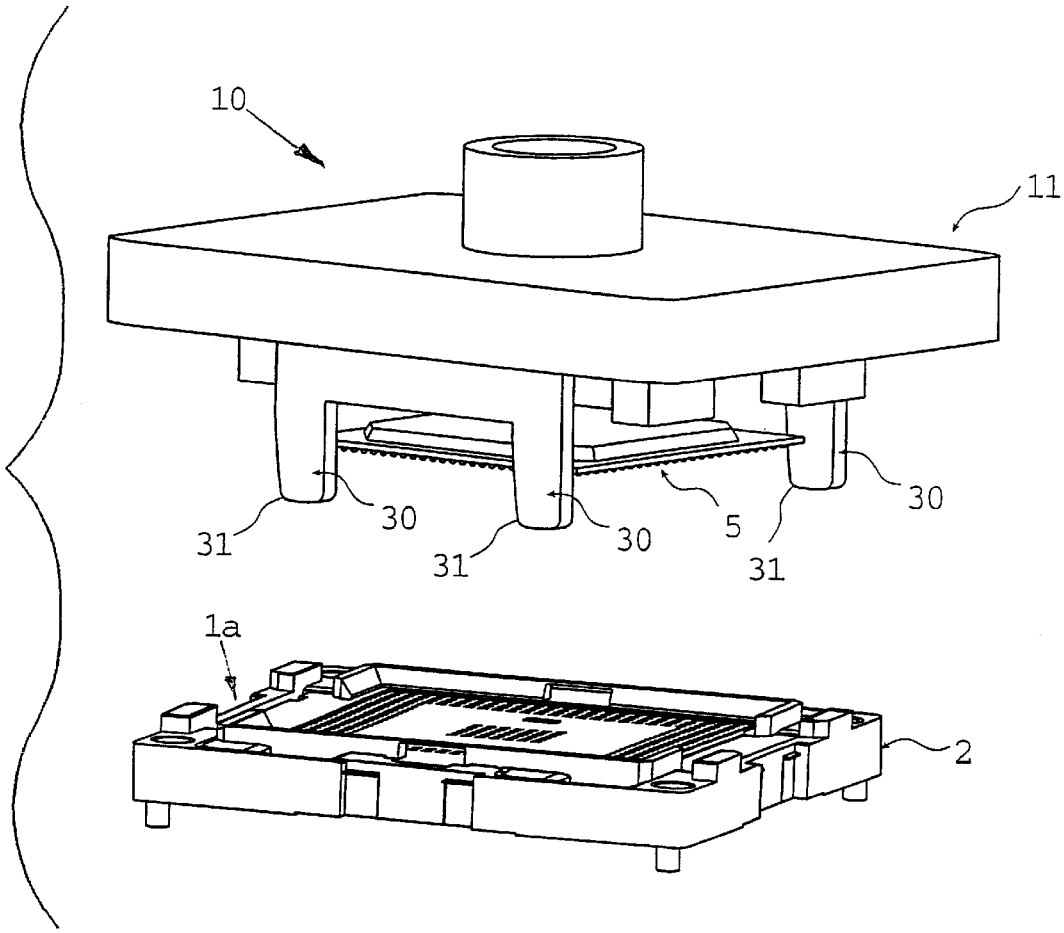
FIG. 5 is an exploded perspective view of a main body and a head made in accordance with an alternate preferred embodiment along with a BGA package.
Figure 6A:
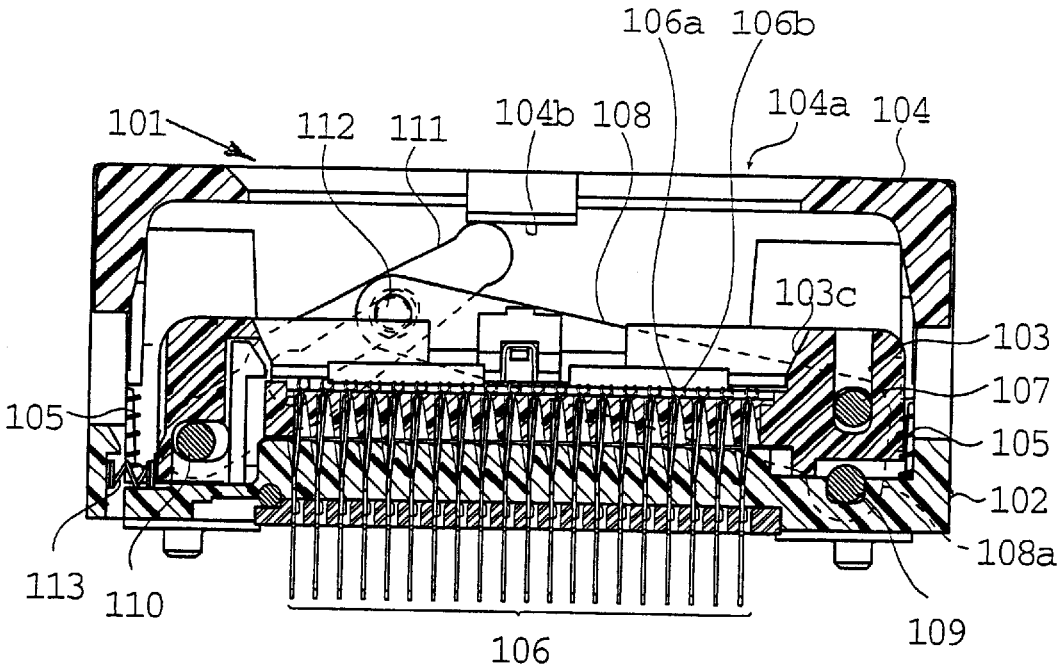
PRIOR ART FIG 6a
FIGS. 6*a* and 6*b* are cross sectional views of a prior art socket used for burn-in tests.
Figure 6B:
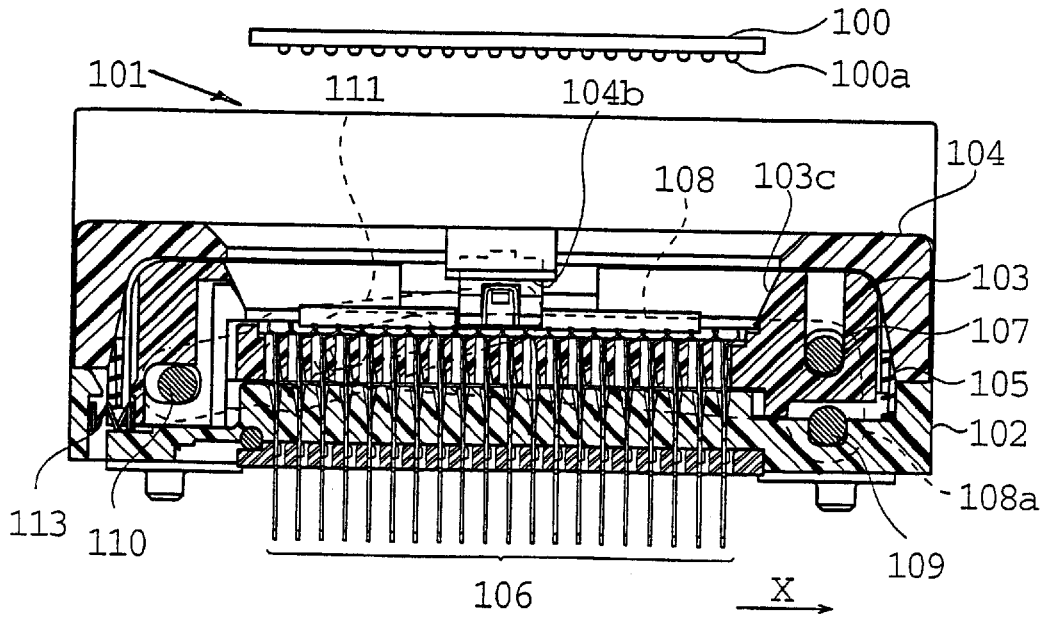
PRIOR ART FIG 6b

With reference to FIG. 5, an electric part loading device or socket 10 made according to another embodiment of the invention comprises a head 11 capable of holding a BGA package 5 by air suction. Head 11 is vertically movable when arranged at a position corresponding to slide member 4 of base 2 and includes force transfer portions 30 as described above. Force transfer portions 30 extend downwardly from head 11 at locations that correspond to those of slide member 4 at the same interval as the interval of forcing receiving surfaces 43 of slide member 4. Engagement surfaces 31 having an angular part in the shape of a slightly curved surface are formed at the lower part on the side of the direction indicated by arrow head A (FIG. 4) of the force transfer portions 30 of head 11, the side in the direction where arm 6*a* of the contact is opened. In view of the placement of force transfer portions on head 11, cover 3 for the socket is no longer needed, with a result that it becomes possible to reduce still further the number of parts used for the electric part loading device and thus simplify the construction and reducing the size and weight. As the other structure, effects and functions are the same as in the first described embodiment, a detailed explanation thereof will not be repeated.

The invention is not intended to be limited to the specific embodiments described above. For example, while the force receiving surfaces 43 of the slider are inclined by a selected angle relative to the opening and closing directions of arms 6*a*, 6*b* of the contact members, it is possible to incline the engagement surfaces of the force transfer portions 30 in the same manner. Even though the slider and the adaptor have been formed integrally, they can also be formed as separate members. It should also be noted that sockets of the invention can be used not only for burn-in tests but also can be used in various electric property tests. Further, sockets made in accordance with the invention can be used not only in the case of BGA packages but also with various other packages including the PGA package, etc.

According to the invention which has been described above, it becomes possible to drastically reduce the number of the parts involved and simplify the structure thereof. In addition, the assembling steps can also be simplified. Further, the size and weight of the socket can be reduced. According to the invention, moreover, an electric part loading device of light weight, whose construction is simplified, can be obtained.

It is the intention that the invention include all modifications and equivalents of the disclosed embodiments falling within the scope of the appended claims.

What is claimed:

1. An electrical socket comprising a base for removably loading an electric part having a plurality of conductive terminals arranged in a selected pattern, a slide member mounted on the base and being movable in a horizontal direction back and forth between two extremities, the slide member being formed with the contact receiving holes therethrough and a contact actuating member, a plurality of contact members mounted on the base and arranged in accordance with the pattern of the conductive terminals of each electric part, each contact member having at least one movable contact arm extending through the contact receiving holes, the contact actuating member engaging the at least one contact arm of each contact member to move each contact member between an open and a closed position, the slide member formed with force receiving surface forming an angle relative to the horizontal direction and a motion transfer member vertically movable into engagement with the force receiving surface to transfer motion directly to the slide member causing it to move.

2. An electrical socket according to claim 1 further comprising a plurality of motion transfer members movable into and out of engagement with a plurality of force receiving surfaces of the slide member.

3. An electrical socket according to claim 2 further comprising a cover which mounts the motion transfer members.

4. An electrical socket according to claim 2 further comprising a head which mounts the motion transfer members and a holding portion for removably holding an electronic part.

5. An electrical socket according to claim 4 in which the holding portion for holding the electric part comprises an air suction device.

6. An electrical socket for removably receiving an electric part having a plurality of terminals arranged in a selected pattern comprising a base, a slide member mounted on the base and being movable in a horizontal direction back and forth between first and second extremities, a spring member biasing the slide member in one direction between the extremities, the slide member being formed with an electric part seating surfaces and contact arm receiving holes therethrough and an actuating member, a plurality of contact members mounted in the base, each contact member having a pair of movable spring contact arms extending through the contact arm receiving holes, the contact actuating member engaging at least one contact arm of each pair to move a contact arm of each pair relative to the other contact arm of the respective pair upon movement of the slide member, the slide member formed with a force receiving surface forming an angle of more than zero degrees and less than 90 degrees relative to the horizontal direction and a motion transfer portion vertically movable into engagement with the force receiving surface to transfer motion directly to the slide member causing the slide member to move against the bias of the spring member.

7. An electrical socket according to claim 6 in which the force receiving surface is generally flat.

8. An electrical socket according to claim 6 further comprising a cover having a central opening therethrough, the cover vertically movable toward and away from the base and the motion transfer portion is wedge-shaped and extends downwardly from the cover.

9. An electrical socket according to claim 8 further comprising a plurality of wedge-shaped motion transfer portions extending downwardly from the cover and a plurality of force receiving surfaces are formed on the slide member, each motion transfer portion being aligned with a respective one of a plurality of force receiving surfaces.

10. An electrical socket according to claim 9 in which each motion transfer portion includes a tapered, generally vertically disposed engagement surface for engagement with a respective force receiving surface of the slide member.

11. An electrical socket according to claim 10 in which each tapered engagement surface forms a slight curve.

12. An electrical socket according to claim 6 further comprising a head having an air suction, electric part holding portion, the head vertically movable toward and away from the base and the motion transfer portion is wedge-shaped and extends downwardly from the head.

13. An electrical socket according to claim 12 further comprising a plurality of wedge-shaped motion transfer portions extending downwardly from the head and a plurality of force receiving surfaces are formed on the slide members, each motion transfer portion aligned with a respective one of the plurality of force receiving surfaces.

14. An electrical socket according to claim 13 in which each motion transfer portion includes a tapered, generally vertically disposed engagement surface for engagement with a respective force receiving surface of the slide member.

* * * * *